United States Patent [19]

Hirsch

[11] Patent Number: 4,974,836

[45] Date of Patent: Dec. 4, 1990

[54] RESISTANCE WEIGHT KIT

[76] Inventor: David E. Hirsch, 16 Sleepy Hollow, Hamburg, N.Y. 14075

[21] Appl. No.: 341,029

[22] Filed: Apr. 19, 1989

[51] Int. Cl.[5] ..... A63B 21/06

[52] U.S. Cl. ..... 272/117; 272/62; 272/900; 273/26 R

[58] Field of Search ..... 272/62, 63, 116, 117, 272/123, 900; 273/26 R, 26 B

[56] References Cited

U.S. PATENT DOCUMENTS

| | | | |
|---|---|---|---|
| 2,134,451 | 10/1938 | Mogren | 272/117 |
| 3,572,702 | 3/1971 | Dorn | 272/123 |
| 4,109,907 | 8/1978 | Zito | 272/117 |
| 4,243,219 | 1/1981 | Price | 272/117 |
| 4,290,598 | 9/1981 | Flannery | 272/17 |
| 4,328,964 | 5/1982 | Walls | 273/26 R |
| 4,344,618 | 8/1982 | Dudley | 272/117 |
| 4,619,453 | 10/1986 | Plumridge | 272/117 |

*Primary Examiner*—Robert Bahr

*Attorney, Agent, or Firm*—Hodgson Russ Andrews Woods & Goodyear

[57] ABSTRACT

A resistance weight kit which may be readily installed in a door frame. The resistance weight kit includes an extendable screw threaded support bar assembly (22) having rubber feet (28) at either end which may engage the sides of a door frame in an elevated position. Mounted on the support bar assembly are two radiallly outwardly extending eyes (52). A first pulley block (14) may be secured to one of the eyes (52) by a quick connector (60). A second pulley block (16) is provided and intermediate portions (74, 76) of a primary rope (18) engage the sheaves (58) of each of the pulley blocks. The ends of the rope are formed into eyes and one end (80) may be connected to the other radially outwardly extending eye (52) by another quick connector (60). A weight holder (12) is connected to an eye (56) on the second pulley block (16) by another quick connector (60). An engagement device is connected to the eye (78) on the other end of the rope by another quick connector (60). The engagement device may be a baseball (88) with an extension length of rope (86). Alternatively, it may be a cross bar (110) or ankle band (122). The kit may further include a platform (20) having a third pulley block (114) mounted thereon, another extension length of rope (116) passing through the pulley block and having eyes at either end, the platform mounted extension length of rope also being quickly connectable.

The kit may be used for physical therapy and rehabilitation after injury or surgery, and also for physical training, such as for example in instructiong a baseball player in the proper overhand throwing technique.

5 Claims, 2 Drawing Sheets

Fig. 1.
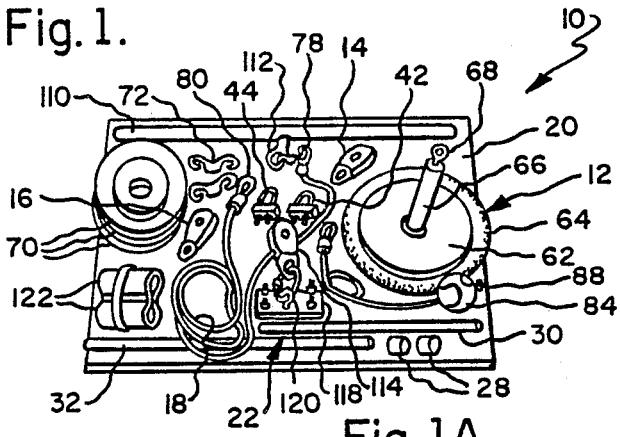
Fig. 1A.
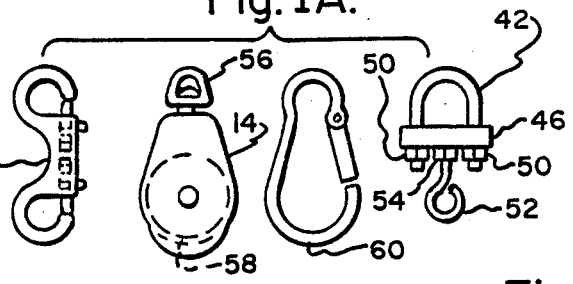
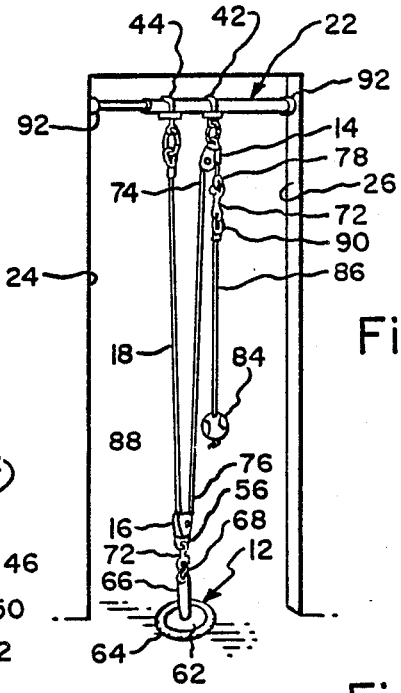
Fig. 2.
Fig. 4.
Fig. 5.
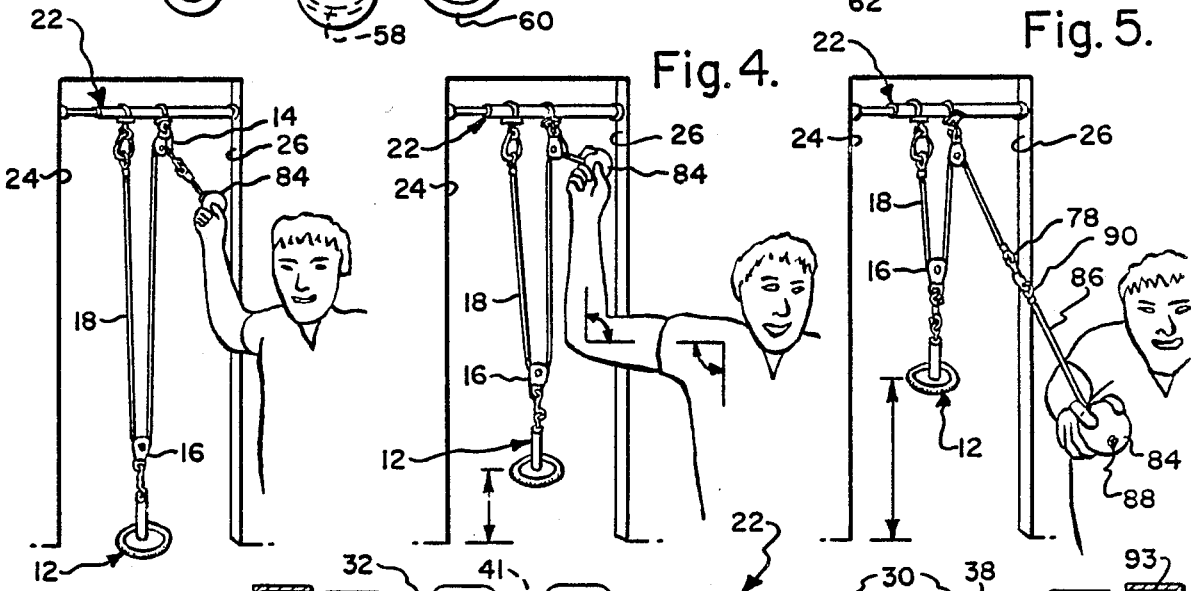
Fig. 3.
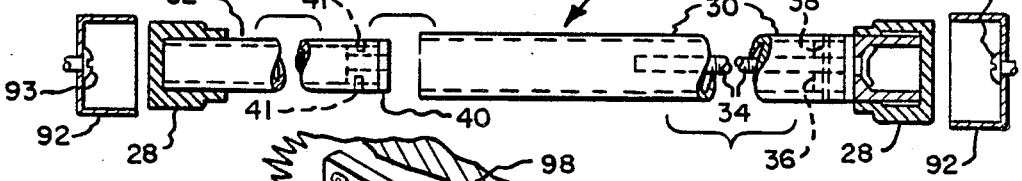
Fig. 2A.
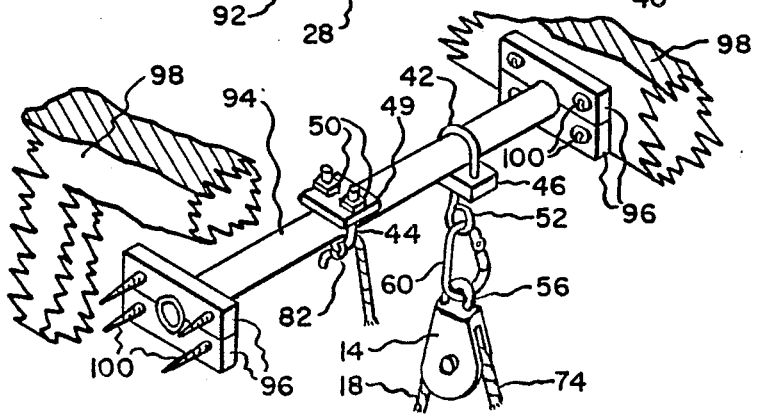
Fig. 6.

Fig. 7.
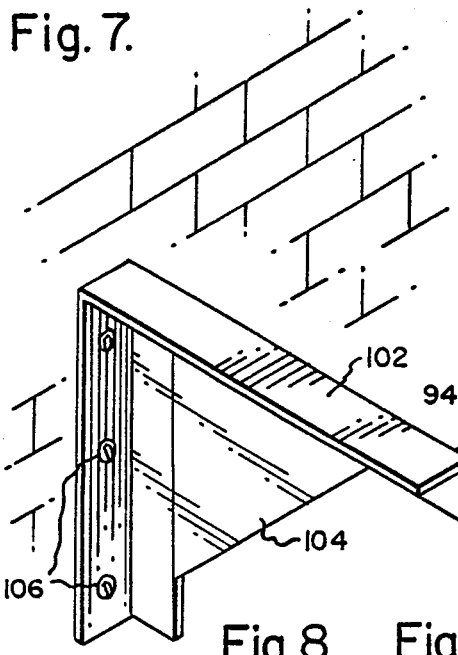
Fig. 14.
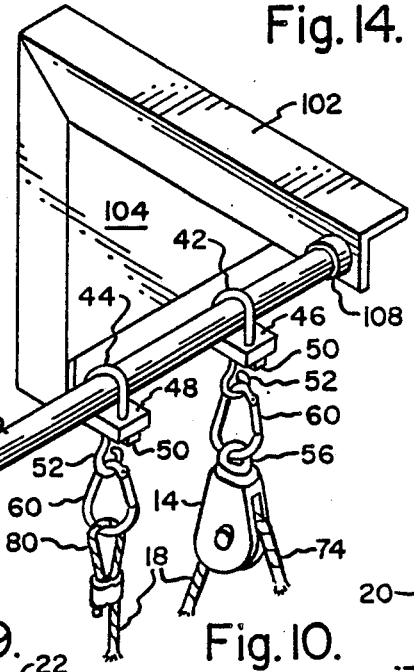
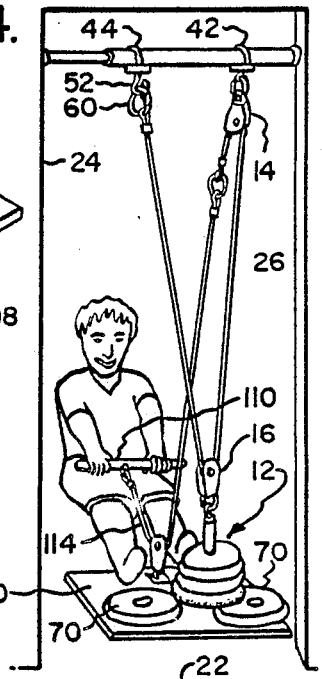
Fig. 8.
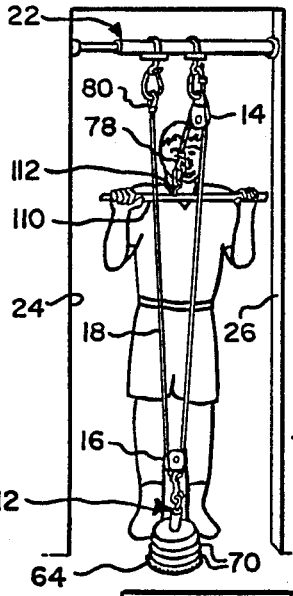
Fig. 9.
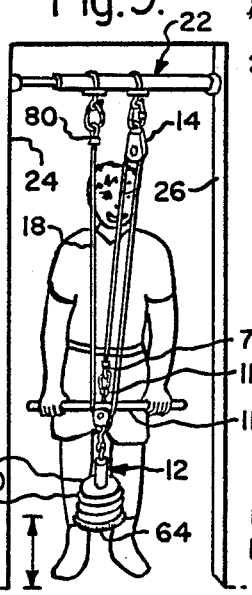
Fig. 10.
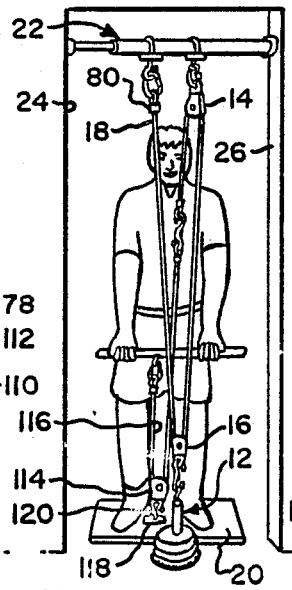
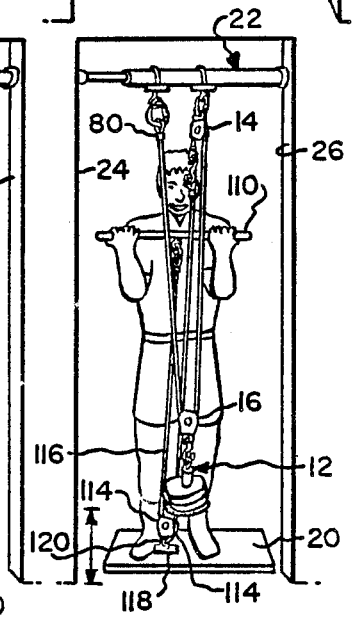
Fig. 11.
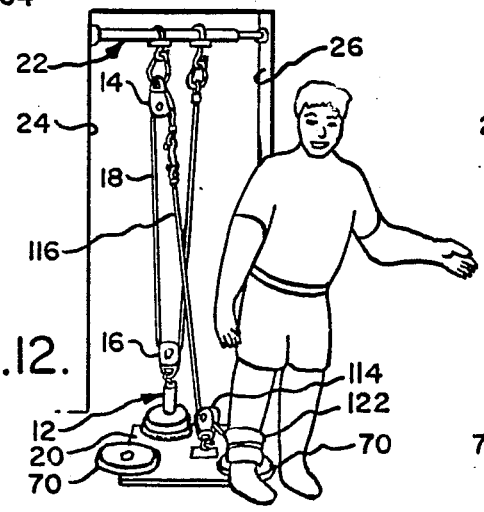
Fig. 12.
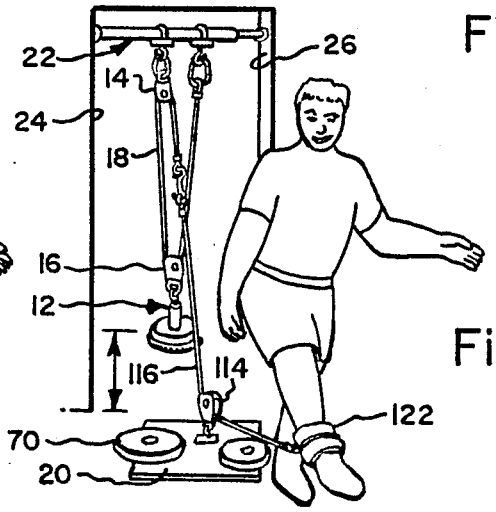
Fig. 13.

RESISTANCE WEIGHT KIT

TECHNICAL FIELD

The present invention relates generally to a resistance weight kit which may be used for physical fitness training, rehabilitation and therapy by resistance, the resistance being developed by utilization of pulley blocks and weights, and which apparatus may be broken dowm into a kit which is easily transported, and which apparatus may additionally be utilized for training a baseball player in the proper throwing motion.

BACKGROUND OF THE INVENTION

In the past resistance apparatus of varying types have been developed. Thus, apparatus has been developed to facilitate training in various sports, such as in tennis, and hitting a baseball. One such device is shown in U.S. Pat. No. 2,134,451. This device includes a pulley block which is adapted to be mounted to a wall, a rope which passes over the sheave in the pulley block and which has one end secured to the block, and a second pulley block, an intermediate portion of the rope engaging the sheave on the second pulley block, which second pulley block carries a weight. A baseball bat or tennis racket may be secured to the free end of the rope, and the swinging of the bat or racket is resisted by the weight carried by the second pulley block. While this device may be successful for its intended purposes, it has the disadvantages in that it must be more or less permanently secured to a wall, and it only has limited applications.

U.S. Pat. No. 4,109,907 discloses a home exercise device which includes clip means for removeable engagement over the upper edge of a door, which clip means support pulley blocks to which weights and resistive training devices may be secured. While this device may be useful for its intended purposes, it lacks versatility and requires that a door be utilized.

It has been suggested that a resistance weight training device may be secured within a door frame and this is shown in U.S. Pat. Nos. 4,243,219 and 4,344,618. Neigher one of these patents discloses a device which may be readily carried from one location to another. U.S. Pat. No. 4,619,453 also discloses a door frame resistance training device, but this device is unduly complicated.

U.S. Pat. No. 4,290,598 discloses a resistance or tension exerciser which may be supported from the joists of a ceiling.

Other apparatus has been developed for use in rehabilitation of injuries and for physical thereapy. However, most rehabilitative apparatus is either very specialized, expensive, or both.

OBJECTS AND SUMMARY OF THE PRESENT INVENTION

It is an object of the present invention to provide a resistance weight device which overcomes the disadvantages of the prior art, which is readily portable, and which is utilized in ways not envisioned by the prior art.

It is a one object of the present invention to provide a resistance weight kit which is portable and which may readily be installed in a doorway, the resistance weight kit including an extendable screw threaded support bar assembly having rubber feet at either end which may be mounted within a door frame in an elevated position, a rope, pulley blocks, weights, and other devices which may be assembled together into a variety of forms, and engagement means to which a resistance is applied when secured to one end of the rope, which engagement means (which may be a baseball) may be engaged by the user of the kit for physical fitness training physical therapy or for rehabilitation.

It is another object of the present invention to provide a resistance weight training apparatus which may be utilized to train a baseball player in the proper overhand throwing motion, the resistance training apparatus including a baseball which is secured to one end of a rope or line, a length of the line immediately adjacent to the baseball being adapted to overlie a player's forearm at the completion of an overhand throwing motion, the line in turn being secured by means of pulley blocks in an elevated support to a weight which applies a resistive force to the baseball, preferably in the range of 2–8 pounds.

The foregoing objects and other objects and advantages of the present invention will be more fully understood after a consideration of the following detailed description taken in conjunction with the accompanying drawings in which preferred forms of the present invention are illustrated.

BRIEF DESCRIPTION OF THE DRAWINGS

FIG. 1 is a perspective view of a resistance weight kit which embodies the principles of this invention.

FIG. 1A is an enlarged view of various of the elements of the kit shown in FIG. 1.

FIG. 2 shows how the kit of FIG. 1 may be assembled in a doorway when the kit is to be used as a training apparatus for training a baseball player or the like in the proper overhand throwinng motion.

FIG. 2A is an enlarged partially exploded view of the extendable screw threaded support bar assembly shown in FIG. 2.

FIGS. 3, 4 and 5 illustrate how the kit, when assembled in the manner shown in FIG. 2, may be utilized.

FIG. 6 illustrates a resistance weight apparatus mounted to ceiling joists, this view illustrating a modification of the kit shown in FIG. 1, and also illustrating a differing manner of securing various parts together.

FIG. 7 illustrates another modification of the resistance weight kit shown in FIG. 1, this view illustrating how an apparatus may be mounted to a wall.

FIGS. 8 through 11 illustrate how the resistance weight kit of FIG. 1 may be utilized in various arm exercises.

FIGS. 12 and 13 illustrate how the resistance weight kit of FIG. 1 may be utilized in a leg exercise.

FIG. 14 illustrates how the resistance weight kit may be utilized in a rowing exercise.

DETAILED DESCRIPTION

The resistance weight kit of this invention, which is indicated generally at 10, is shown unassembled in FIG. 1. In the preferred form illustrated the kit includes a weight holder indicated generally at 12, first and second substantially identical pulley blocks or swivel pulleys 14, 16, respectively, a primary rope 18, and additional weights, engagement means, and coupling devices. In addition, the kit may also include a portable platform 20. The details of the kit will be more fully described below in connection with the various embodiments shown in FIGS. 2 through 5 and 8 through 14.

Referring now in greater detail to FIGS. 2 through 5, the kit has been assembled into a physical fitness training apparatus for a baseball player or the like which is capable of training the player in the proper overhand throwing motion, and which is also capable of being used in rehabilitation or in physical therapy, as for example in building up the player's throwing arm. In this embodiment support means in the form of an extendable screw threaded support bar assembly, indicated generally at 22, is mounted between the sides 24 and 26 of a doorway. The support bar assembly 22 is provided with rubber feet 28 at either end so that the sides will not be marred when the support bar assembly is expanded to force the feet into engagement with the sides, and also to prevent the support bar assembly from sliding downwardly when a weight is applied to the bar. The extendable screw threaded support bar assembly is of conventional construction and includes first and second telescoping tubes 30, 32, a threaded rod 34 which is mounted in the first telescoping tube by a bushing 36 and roll pin 38, the threaded rod being received within an internally tapered circular nut 40 which is held within the second telescoping tube by suitable fasteners 41.

Supported on the first telescoping tube 30 are two spaced apart identical U-bolts 42, 44. Two identical mounting blocks 46, 48 are provided to which the U-bolts 42, 44 may be secured, respectively. The legs of each of the U-bolts are secured in place by nuts 50. Each of the mounting blocks or saddles are provided with a centrally located threaded aperture which receives a threaded eye bolt 52, which eye bolt is locked in place by suitable adhesives and nut 54. While the U-bolts 42, 44 are removably secured to the first telescoping tube 30, it should be appreciated that eyes or equivalent apertured structures could be simply welded thereto or otherwise suitably secured.

Each of the pulley blocks is provided with a swivel eye 56 and a single sheave 58. The first pulley block 14 is secured to the eye 52 on the support 22 by means of a quick connector in the form of a rope snap 60. Other suitable connectors may be utilized as will be apparent to those having ordinary skill in the art.

The weight holder 12 is adapted to be supported by the second pulley block or swivel pulley 16 and includes a plate metal disk 62 to which a heavy sponge rubber disk 64 of larger diameter is secured thereto by a suitable adhesive. Extending upwardly from the plate metal disk is a bar or shaft 66 which has an eye 68 secured to its upper end, the shaft 66 preferably being welded to the disk 62. By using this construction the weight holder may rest upon the floor, and in the event that it starts to swing the soft periphery of the rubber disk 64 will prevent injury to the door frame or any other object in which it might encounter. The weight holder has sufficient weight that it may be used without additional weights, particularly when first using the device as a throwing trainer. Additionally, by utilizing this form of construction additional weights in the form of apertured disks 70 may be stacked upon the planar portion or disk 62 of the weight holder to provide additional weight. The weight holder, with or without additional weights is secured to the eye 56 of the second pulley block 16 by means a quick connector, which for example may be a conventional double-ended snap latch 72.

The primary rope 18 has first and second intermediate portions 74, 76, respectively passing over the sheaves of the first and second pulley blocks 14, 16. The first end of the rope is provided with a first eye splice 78 and the second end is provided with a second eye splice 80. The eye splices may be formed by braiding, and it should be apparent that the ends of the rope may be provided with rings or the like to facilitate their quick connections. Alternatively the ends of the rope may be secured in other ways. Thus, the second end of the rope may be provided with a knot 82 as shown for example in FIG. 6, the second end of the rope passing through the U-bolt 44 and being secured in place in the manner indicated. In this design a saddle block 49 is used which is not provided with a central aperture. However, in the preferred design, the second eye splice 80 is secured to the eye bolt 52 in the mounting block 48 by use of rope snap 60. It should be noted that when the second end of the rope is fixed as for example in the manner indicated above that the load of the weight(s) and second pulley block will be equally distributed between the lengths of rope to either side of the second pulley block when the weight is not in contact with the floor.

In the form illustrated in FIGS. 2 through 5 resistance means in the form of a baseball 84 is interconnected to the primary rope 18. In order to facilitate the use of the apparatus with other resistance means, the rope 18 does not extend all of the way to the baseball 84 but is instead provided with the first eye splice 78 referred to above. An extension rope 86 is actually secured to the baseball by the simple expedient of drilling a hole through the baseball, passing one end of the length of the extension rope 86 through the ball, and forming a knot 88 on the end of the rope. The other end of the extension rope 86 is also provided with an eye splice 90 and this in turn is secured to the first eye splice 78 by means of another snap latch 72.

With the device illustrated in FIGS. 2 through 5 a baseball player can be instructed in the proper throwing motion. Thus, the player is instructed to engage the ball in his throwing hand with his arm in a back position and with the weight either in contact with the floor or just above the floor. Then the player is to bring his hand forward in an overhand throwing motion until his arm is in a fully extended position as shown in FIG. 5. If the player does not maintain the right angle relationships between his forearm and upper arm and also between his upper arm and body as indicated in FIG. 4, the player will find that it is painful to throw the ball. Thus, by utilizing this device the player will be encouraged to properly throw the baseball. In addition, as resistance is applied by the weight holder, or any additional weights as desired, the effective weight varying from 2 to 8 pounds in the preferred range, the player will also be strengthening his arm. Thus, this device will encourage adjusting the throwing arm so that less strain is experienced in the shoulder joint by a correct feel concept, which varies slightly from person to person. In other words, the thrower's arm muscle and nervous system makes instant adjustments in the throwing angle to achieve a proper feel, and this adjusted throwing angle provides the best mechanical advantage, putting the arm in the most efficient and safe throwing pattern.

This device is particularly useful to the beginning thrower, such as in Little League baseball where faulty habits can be corrected early. In addition, there is an application here also to the weekend player to avoid wrong throws and to avoid injury to the arm. This device would also be useful in eliminating the already developed faulty throw patterns of high school, college and professional baseball players. In addition, it may be used in warm-up drills in the dugout and can also be used in a rehabilitation program following injury or surgery or for other forms of physical therapy. As can be seen from the above it is readily portable and can be easily assembled in one's room while traveling.

While the preferred support is the portable, easily installed extendable screw threaded support bar assembly 22 illustrated in FIGS. 2 through 5, other forms of support may be utilized, which forms may involve more or less permanent mountings. As shown in FIG. 2A caps 92 may be provided, each cap being capable of receiving an associated rubber foot 28, and the caps being secured to the door frame by screws 93. This design permits more weight to be carried by support 22. In the design shown in FIG. 6 a short length of pipe 94 is supported by lower saddle brackets 96 which are secured to adjacent faces of adjacent joists 98 by screw threaded fasteners 100. Upper saddle brackets 101 may also be used. An alternate embodiment to FIG. 6 is shown in FIG. 7 where L-shaped brackets 102, which are suitably reinforced by gussets 104, are utilized. The L-shaped brackets are secured to a wall or the like by fasteners 106. As can be seen the L-shaped brackets are preferably made of angle iron, adjacent faces of the angle iron having welded thereto tubular portions 108 which can receive a length of pipe 94 of the same type as utilized in FIG. 6.

While FIGS. 3 through 5 illustrate the resistance weight kit of the present invention for use by a baseball player or the like, it should be apparent that the kit of the present invention can be assembled in differing manners for other uses. Thus, for example in FIGS. 8 and 9 an arm pull down exercise is illustrated wherein an engagement means in the form of a cross bar 110 is secured to the first eye splice 78 on the rope. Thus, the cross bar 110 has a centrally located radially outwardly extending eye 112, the eye 112 being secured to the first eye splice 78 by means of a rope snap 60. In this embodiment additional weight is applied to the weight holder 12 by adding the additional weights 70.

In FIGS. 10 and 11 another form of arrangement is illustrated which utilizes the platform 20. The platform is provided with a third pulley block 114 through which an intermediate portion of a length of an extension rope 116 passes, the length of rope 116 being provided with eye splices at either end. The third pulley block is secured to the platform by a base plate 118 which is bolted or otherwise rigidly secured to the platform, the base plate having an upwardly extending eye 120 whih is secured to the eye 56 on the third pulley block by another rope snap 60. It can be appreciated from an inspection of FIGS. 10 and 11 that the platform 20 has a sufficient width so that someone may stand upon it.

The embodiment shown in FIGS. 12 and 13 illustrates how the kit may be assembled so that a leg training exercise or the like may be performed. In this embodiment the various parts are arranged in essentially the same manner as they are in FIGS. 10 and 11 except that a number of additional weights 70 are placed upon the platform 20, the additional weights at least equaling the weight of the weight holder 12 and the additional weights 70 carried thereon. The end of the extension rope 116 remote from the first rope 18 is secured to an ankle band 122. It can be seen by utilizing this device that various leg strengthening exercises or the like may be performed.

Finally, with respect to FIG. 14, it can be seen that a rowing exercise may be performed by the apparatus when assembled in the manner shown in FIGS. 10 and 11 with additional weights being placed upon the platform in the same manner as indicated in FIGS. 12 and 13.

While a resistance weight kit has been disclosed, and while three differing support mechanisms have also been disclosed, it should be noted that other forms of apparatus may be employed in the practice of the broader aspects of this invention. Therefore, while preferred structures in which the principles of the present invention have been incorporated have been shown and described above, it is to be understood that this invention is not to be limited to the particular details shown and described above, but that, in fact, widely differing means may be employed in the practice of the broader aspects of this invention.

What is claimed is:

1. A resistance weight kit capable of being assembled within a door frame in a home or the like whereby various resistive training exercises may be performed; the kit comprising the combination of:

an extendable screw threaded support bar assembly having rubber feet at either end capable of firmly engaging the sides of a door frame when the support bar assembly is expanded to hold the support bar assembly in place, the support bar assembly carrying between its ends a radially outwardly extending load carrying eye;

a weight having a circular plate-like portion adapted to rest upon the floor and a centrally located rod-like portion extending upwardly from the center of the plate-like portion, the rod-like portion having an eye on its upper end, the periphery of the plate-like portion being sufficiently soft so that it will not injure the door frame if it should swing into the frame;

first and second single sheave pulley blocks, each having an outwardly extending eye;

first and second connectors connecting the eyes on the first and second pulley blocks with the eyes on the support bar assembly and the weight, respectively;

a primary rope having first and second ends and first and second intermediate portions adapted to be passed over the sheaves of the first and second pulley blocks, respectively, the second end of the rope being connected to the support member adjacent the load carrying eye; and engagement means adapted to be secured to the first end of the rope and which may be engaged by a user of the kit for physical fitness training, rehabilitation, or physical therapy.

2. The resistance weight kit as set forth in claim 1 wherein the engagement means includes a baseball and an extension rope secured to the baseball, and coupling means capable of securing the primary rope to the extension rope.

3. The resistance weight kit as set forth in claim 1 wherein the engagement means is a bar having a centrally located radially outwardly extending eye, and coupling means capable of securing the end of the primary rope to the eye on the bar.

4. The resistance weight kit as set forth in claim 1 wherein the kit further includes a plurality of apertured disk-like additional weights which may be disposed about the upwardly extending rod-like portion of the weight to further increase its weight.

5. The resistance weight kit as set forth in claim 1 wherein the kit further includes a portable platform having a width sufficiently wide that someone may stand on it, a third single sheave pulley block being mounted upon the upward side of the platform, a portion of an extension rope being adapted to be passed over the sheave of the third pulley block, and coupling means capable of securing the extension rope to the primary rope, wherein the engagement means is an ankle band which may be secured about the ankle of a user, and further including additional coupling means for securing the ankle band to one end of the extension rope.

* * * * *